US006758762B2

(12) United States Patent
Markwood

(10) Patent No.: US 6,758,762 B2
(45) Date of Patent: Jul. 6, 2004

(54) GOLF CLUB GRIP IN COMBINATION WITH BALL MARKER AND DIVOT REPAIRER

(76) Inventor: Carl Casey Markwood, 7654 Greenridge Way, Fair Oaks, CA (US) 95628

( * ) Notice: Subject to any disclaimer, the term of this patent is extended or adjusted under 35 U.S.C. 154(b) by 0 days.

(21) Appl. No.: 10/305,873

(22) Filed: Nov. 27, 2002

(65) Prior Publication Data

US 2003/0104875 A1 Jun. 5, 2003

Related U.S. Application Data

(60) Provisional application No. 60/337,521, filed on Dec. 5, 2001.

(51) Int. Cl.[7] ..... A63B 57/00

(52) U.S. Cl. ..... 473/285; 473/286

(58) Field of Search ..... 473/285, 286, 473/284, 282, 406, 408, 300–303

(56) References Cited

U.S. PATENT DOCUMENTS

| | | | | |
|---|---|---|---|---|
| 1,587,082 A | * | 6/1926 | Mattern | 473/201 |
| 2,221,421 A | * | 11/1940 | Curry | 473/300 |
| 3,774,913 A | | 11/1973 | Dien | |
| 3,791,652 A | | 2/1974 | Schuler | |
| 4,822,052 A | | 4/1989 | Dimmick et al. | |
| 4,858,925 A | * | 8/1989 | DeStefano, Jr. | 473/285 |
| 4,925,190 A | | 5/1990 | Learned | |
| 5,171,621 A | * | 12/1992 | Desbiolles et al. | 428/141 |
| 5,377,977 A | | 1/1995 | MacNeary | |
| D395,068 S | | 6/1998 | George | |

OTHER PUBLICATIONS

2000 Bass Pro Shop's Spring Catalog; 2000 Spring Fever Sale; p. 119; "Lure Retrieving Mechanisms".

* cited by examiner

*Primary Examiner*—Stephen Blau
(74) *Attorney, Agent, or Firm*—Hahn, Loeser & Parks LLP; W. Edward Crooks, Esq.

(57) ABSTRACT

The present is a novel golf grip capable of retaining a divot repairer and a ball marker. In a preferred embodiment the golf grip is a putter grip. The grip has an open end, a closed end, and a hollow body portion for accepting a golf club shaft. The closed end of the grip a slot is formed for insertion and retention of a divot repairer. In the body portion of the grip, proximate the closed end at least one aperture is formed in the grip for insertion and retention of a ball marker. The ability to retain a divot repair tool and a ball marker within a club grip, such as a putter grip, allows the golfer to readily repair the course during play, as well as speed up the course of play.

19 Claims, 4 Drawing Sheets

GOLF CLUB GRIP IN COMBINATION WITH BALL MARKER AND DIVOT REPAIRER

CROSS-REFERENCE TO RELATED APPLICATIONS

This application claims the benefit of U.S. Provisional Application No. 60/337,521, filed Dec. 5, 2001. Application serial No. 60/337,521 is hereby incorporated by reference.

TECHNICAL FIELD

The present invention relates generally to grips for golf clubs. More specifically, the present invention relates to grips for putters that secure a ball marker and divot repairer, thus allowing for convenient access to both articles as needed during play.

BACKGROUND OF THE INVENTION

The game of golf has exploded in popularity in recent years. The increase in the number of golfers potentially increases damage to the golf courses by golfers. Golf etiquette dictates that golfers must repair divot, dimple, or ball marks made from the golfer's ball striking the green. Additionally, golfers periodically mark the position of their ball on the green so as to not interfere with another golfer's path to the hole.

Golfers everywhere have problems keeping divot repairers and ball markers organized and available as needed. If a divot repairer is not easily located, a golfer is unlikely to fix his or her divot properly. Golfers continually rummage through their golf bags before or during a round of golf, looking for divot repairers and ball markers. Accordingly, there is a need for increased organization of divot repairers and ball markers so that both are readily available during play.

U.S. Pat. No. 3,774,913, issued to Dien, attempts to solve the problem of organization of divot repairers and ball markers. The invention comprises a means for attaching both a ball marker and a divot repairer to the butt end of a golf club. However, the invention has a number of limitations. Snaps are required to affix the ball marker to the divot repairer, which increases the cost of production. Additionally, the handle of the divot repairer is either hinged in relation to the prongs or at nearly a right angle in relation to the prongs. A hinged handle increases the cost of production of the divot repairer. A handle that is at nearly a right angle in relation to the prongs is difficult to use.

U.S. Pat. No. 3,791,652, issued to Schuler, again attempts to attach a divot repairer and ball marker to the butt end of a golf club. However, in this invention, the ball marker cannot be removed from the club without first removing the divot repairer, which is not desirable.

Accordingly, there is a need for a golf club grip for use with putters and the like, which incorporates a ball marker and a divot repairer which are easily accessed by the golfer, while also having an ease of use and decreased cost of production. Accordingly, the present invention is hereby presented.

SUMMARY OF THE INVENTION

It is an object of the present invention to provide a novel golf club grip with a ball marker and divot repairer removably attached to the golf club grip.

Another object of the present invention is to provide a golf club grip which is inexpensive to produce.

Yet another object of the present invention is to provide independent access to either the ball marker or the divot repairer.

A preferred embodiment of a golf club grip with ball marker and divot repairer comprises a golf club grip of a shape and composition generally known in the art. The grip comprises a hollow body with two ends. The first end of the grip is open and adapted to slideably receive a golf club shaft. The second end of the grip is closed with a slot integrally located within said second end. The slot is adapted to slideably receive a divot repair tool.

A preferred embodiment of a golf club grip additionally comprises a means for removably attaching a ball marker. A preferred embodiment for removably attaching a ball marker comprises an aperture through the surface of said body. Said aperture is preferably located near the second end of said body, so that the ball marker will not interfere with the golfer while putting. Alternatively, more than one aperture may be provided near the end of the golf grip body, into which a golfer may selectively insert the ball marker into one of the apertures.

The divot repairer comprises a single-prong repair tool integral with a handle. Alternatively, the divot repairer may comprise a double-prong repair tool with an integral handle. The divot repairer is adapted to slideably insert into the slot located in the second end of the grip. Preferably, the divot repairer is held in the slot by friction resistance, but any method known in the art is contemplated.

The ball marker comprises a composition and shape generally known in the art. The ball marker preferably comprises a substantially flat disc with a shaft extending perpendicularly from the center of one side of the disc. The ball marker is retained in the golf club grip through use of the aperture in the golf club grip body. In a preferred embodiment of the ball marker, the shaft has an enlarged tip. The enlarged tip aids in securing the ball marker within the corresponding aperture in the grip.

DETAILED DESCRIPTION OF THE INVENTION

Reference will now be made in detail to the present preferred embodiments of the invention as illustrated in the accompanying drawings.

Figure 1:
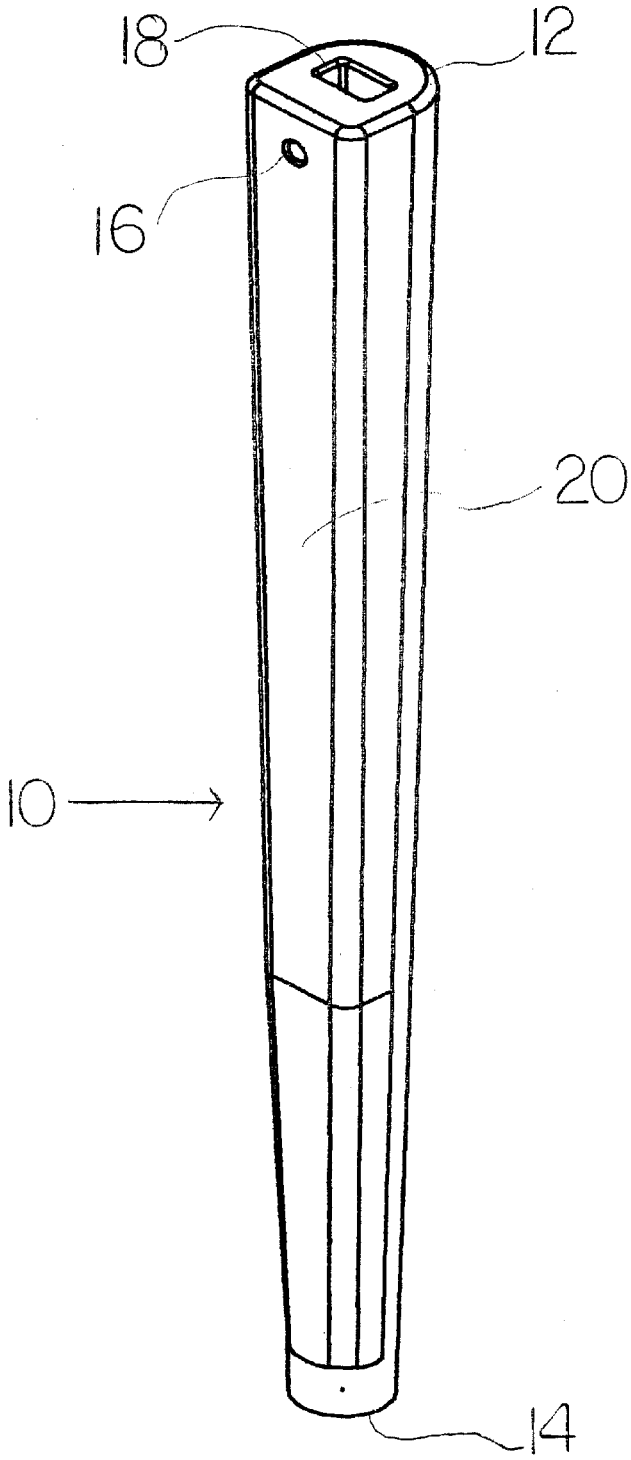
FIG. 1 is a perspective view of a preferred embodiment of the golf grip of the present invention.

A preferred embodiment of a golf club grip adapted to receive a ball marker and divot repairer is shown generally as 10 in FIG. 1. Grip 10 comprises a golf club grip 20 adapted to removably attach at least one ball marker 26, and a single-prong divot repairer 24 ("divot repairer") as in FIGS. 2 & 3.

Golf club grip 10 generally comprises any of a plurality of shapes and compositions of grips known in the art. The length of golf club grip 10 can vary without deviating from the scope of the present invention. Golf club grip 10 is preferably made of a suitable rubber or other polymer, and adapted to slideably mount on a golf club shaft. Additionally, golf club grip 10 may include a wrap or grip tape adhered to the polymer.

Golf club grip 10 comprises a first end 14, a second end 12, and a grip portion 20, disposed between first end 14 and second end 12. First end 14 is open and creates a hollow interior 22 within grip 10. Grip 10 and hollow interior 22 are adapted to slideably receive a golf club shaft. In a preferred embodiment, grip 10 slideably receives a golf club shaft up to a location at least one-half inch from the second end 12 of golf club grip 10. For example, the interior 22 can have a rim, flange, lip, or decreased interior diameter that prevents the golf club shaft from extending completely to second end 12 of grip 10.

Second end 12 of grip 10 is closed with a slot 18 formed within said second end 12. Slot 18 is adapted to receive and retain a divot repairer 24. In a preferred embodiment, second end 12 is of sufficient thickness to enable golf club grip 10 to resist tearing as divot repairer 24 is inserted and removed from slot 18. In a preferred embodiment, second end 12 is approximately one-sixteenth to one-eighth-inch thicker than a standard golf grip. Additionally, slot 18 can be offset from the center of second end 12, so that an inserted divot repairer 24 does not interfere with an inserted ball marker 26.

Figure 2:
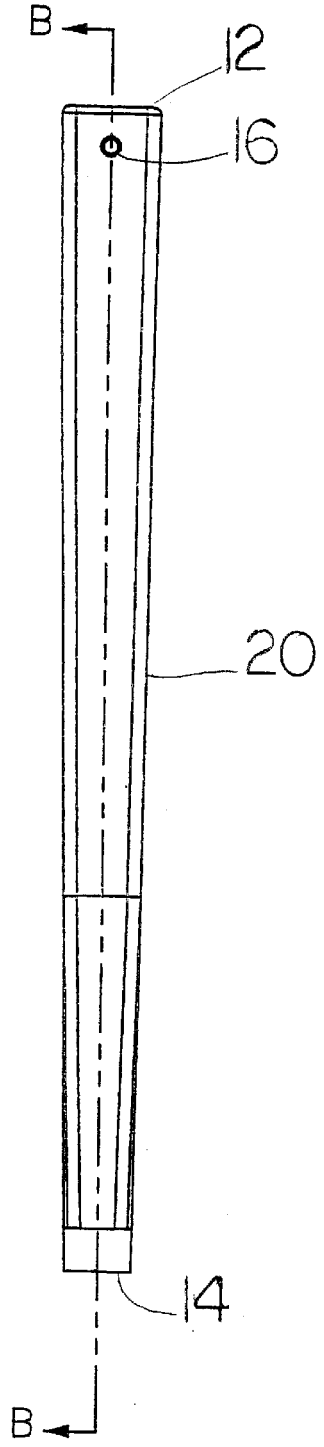
FIG. 2 is a front perspective view of the golf grip, illustrating an aperture for a ball marker.
Figure 3:
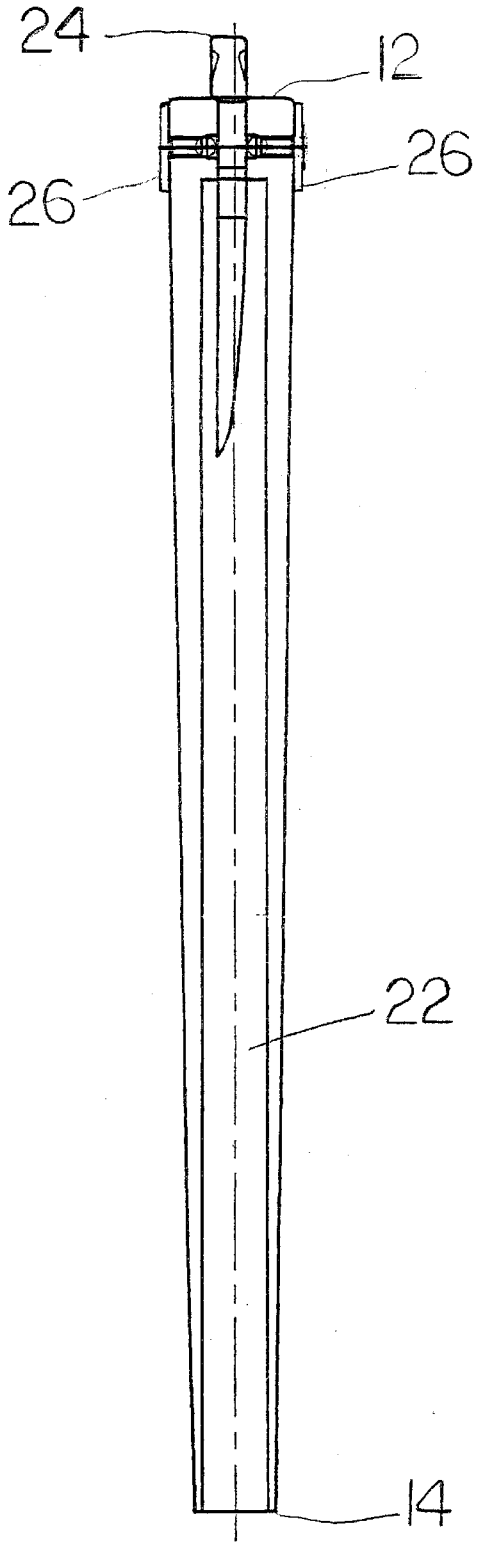
FIG. 3 is a side cross sectional view of the golf grip of the present invention along section B—B, including the divot repairer and ball marker inserted.

Preferably, grip 10 further comprises at least one aperture 16 adapted to receive the shaft 34 of a ball marker 26. Aperture 16 is located within the body of golf club grip 10 near second end 12, in the region of the golf grip body 20 that does not overlay the mounted golf club shaft (not shown). In a preferred embodiment of the present invention, the aperture 16 is formed in the front and/or rear sides of grip 10, as shown in FIGS. 2 and 3. Accordingly, the golf club shaft will not obstruct aperture 16. By storing ball marker 26 in the body of golf grip 10 near second end 12, ball marker 26 will not contact the golf club shaft when inserted into aperture 16. Further, locating the ball marker 26 in this position is unlikely to interfere with the user while putting.

Figure 6:
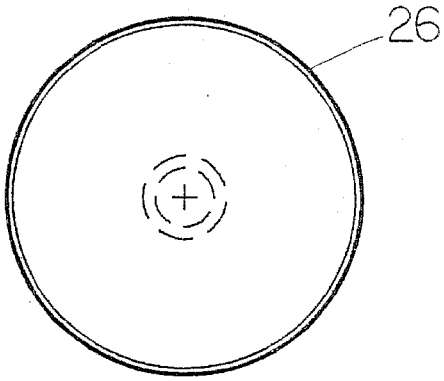
FIG. 6 is a top view of the ball marker for use with the golf grip of the present invention.
Figure 7:
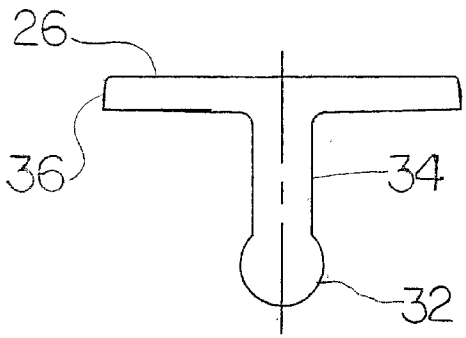
FIG. 7 is a side view of the ball marker for use with the golf grip of the present invention.
Figure 8:
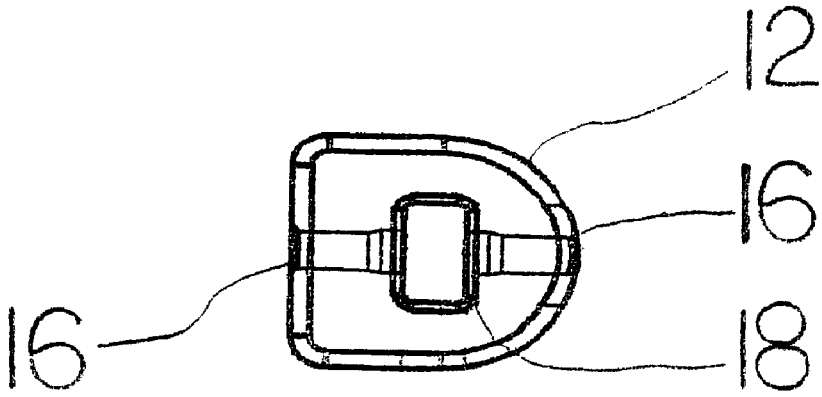
FIG. 8 is a top cross sectional view of a preferred embodiment of the golf grip of the present invention.

The diameter of aperture 16 is approximately the size of the diameter of a shaft of a ball marker known in the art, as shown in FIGS. 6 and 7. In a preferred embodiment, the diameter of aperture 16 is approximately one-eighth of an inch. In operation, a user inserts ball marker 26 into aperture 16 when the user desires to store ball marker 26. Preferably, ball marker 26 is frictionally held within aperture 16 by the tip 32. However, other means as are known in the art for securing ball marker 16 to golf club grip 10 are contemplated. As shown in FIG. 8, aperture(s) 16 may include a socket for retaining tip 32 within aperture 16.

A preferred embodiment of a ball marker 26 is illustrated in FIG. 7. Ball marker 26 comprises a generally flat disc 36 with a shaft 34 extending perpendicularly from the center of one side of disc 36. In a preferred embodiment of ball marker 26, shaft 34 has an enlarged tip 32. This enlarged tip 32 aids in securing ball marker 26 within aperture 16 in golf grip 10. Preferably, enlarged tip 32 is of a diameter slightly larger than aperture 16 in golf grip 10.

In operation, when the user applies force and inserts ball marker 26 into aperture 16, aperture 16 expands to accommodate enlarged tip 32. After ball marker 26 is fully inserted within aperture 16, aperture 16 contracts around tip 32 and shaft 34 due to the resilient property of golf grip 10. Accordingly, ball marker 26 is secured within aperture 16 until the user desires to remove it.

Figure 4:
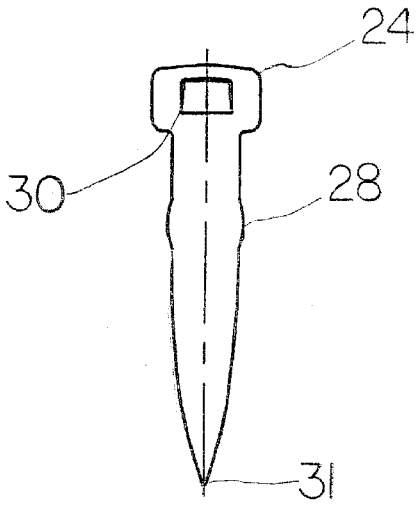
FIG. 4 is front view of the divot repairer for use with the golf grip of the present invention.
Figure 5:
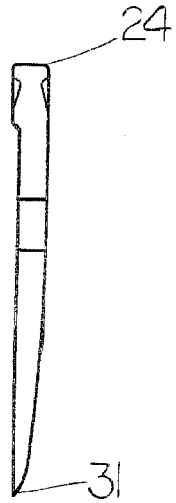
FIG. 5 is a side view of the divot repairer for use with the golf grip of the present invention.

A preferred embodiment of a divot repairer 24 is illustrated in FIGS. 4 and 5. Divot repairer 24 comprises a single prong with a first pointed end 31 and a second handle end 30. It is contemplated that the shape and size of the handle end 30 can be any of a plurality of shapes and sizes suitable for gripping and manipulation of divot repairer 24. In a preferred embodiment, divot repairer 24 is constructed of a rigid plastic or metal. However, any of a plurality of compositions as are known in the art are contemplated.

Preferably, the prong of divot repairer 24 tapers from a maximum width of approximately one-half inch near the handle end 30 to a pointed tip 31. Such a tapering into a pointed tip 31 reduces damage to a green when the user repairs a divot. Divot repairer 24 is of sufficient thickness as to resist deformity while in use. Further, in a preferred embodiment, divot repairer 24 includes a shoulder 28 formed along its length. Shoulder 28 aids in retaining divot repairer 24 within slot 18.

In operation, when the user desires to employ divot repairer 24, he or she removes it from grip 10, fixes the divot, and returns divot repairer 24 to its storage position. In a preferred embodiment, the divot repairer 24 is frictionally held within slot 18. By storing a divot repairer 24 within the grip of a golf club, or more preferably a putter, divot repairer 24 is always conveniently located and accessed by the user, because a user normally will not need to utilize a divot repairer until he or she has hit the ball onto a green.

The present invention illustrates a novel combination of a golf grip 10, a single-prong divot repairer 24, and a ball marker 26. The present invention provides convenient storage and access of both divot repairer 24 and ball marker 26 as needed during play. Furthermore, divot repairer 24, and ball marker 26 are sufficiently secure within their individual apertures such that they will not be dislodged while the putter is removed from the golf bag, being placed into the golf bag, or while stored within the golf bag. By removably securing divot repairer 24 and ball marker 26 to golf club grip 10, proper repair to golf greens and speed of play are likely to be increased.

The forgoing disclosure is illustrative of the present invention and is not to be construed as limiting thereof. Although one or more embodiments of the invention have been described, persons of ordinary skill in the art will readily appreciate that numerous modifications could be made without departing from the scope and spirit of the disclosed invention. As such, it should be understood that all such modifications are intended to be included within the scope of this invention. The written description and drawings illustrate the present invention and are not to be construed as limited to the specific embodiments disclosed.

What is claimed is:

1. A golf club grip comprising:

a first end;

a second end;

said first end being open and adapted to receive a golf club shaft;

said second end being closed and forming a tubular passage between said first end and said second end;

a slot formed in said second end extending perpendicularly to the axis of said golf club grip; and, at least one aperture formed in a side of said grip adjacent to said second end, wherein said at least one aperture is adapted to receive a ball marker.

2. A golf club grip as recited in claim 1, wherein said slot is adapted to receive a divot repairer.

3. A golf club grip as recited in claim 1, wherein said grip further comprises means within said tubular passage for limiting the golf club shaft from extending completely to said second end.

4. A golf club grip as recited in claim 3, wherein said limiting means is comprised of an extension of said second end of said grip.

5. A golf club grip as recited in claim 3, wherein said limiting means is comprised of a rim formed within said tubular passage.

6. A golf club grip as recited in claim 3, wherein said limiting means is comprised of a flange formed within said tubular passage.

7. A golf club grip as recited in claim 3, wherein said limiting means is comprised of a lip formed within said tubular passage.

8. A golf club grip as recited in claim 3, wherein said limiting means is comprised of a decreased diameter of said tubular passage. formed within said tubular passage.

9. A golf club grip as recited in claim 1, wherein said at least one aperture further comprises a socket formed at the internal end of said aperture.

10. In combination:

a golf club having a shaft, a club head attached at a first end of said shaft, and a grip slidably received over and attached at a second end of said shaft;

the grip comprising a first end and a second end; said first end being open and adapted to receive said golf club shaft; said second end being closed and having a slot formed therein; a tubular passage formed between said first end a said second end; a means for limiting the shaft from extending to said second end, said limiting means formed in said tubular passage near said second end; and at least one aperture adapted to receive a ball marker formed in a said of said grip adjacent said second end;

a divot repair tool selectively attached to said grip within said slot; and, a ball marker selectively attached to said grip within said aperture.

11. The combination as recited in claim 10, wherein said divot repair tool comprises a single prong.

12. The combination as recited in claim 11, wherein said divot repair tool further comprises a shoulder formed along the length of said tool.

13. The combination as recited in claim 10, wherein said ball marker comprises a substantially flat disc, a shaft extending perpendicularly from said disc, and an enlarged tip at the end of said shaft.

14. The combination as recited in claim 10, wherein said limiting means is comprised of an extension of said second end of said grip.

15. The combination as recited in claim 10, wherein said limiting means is comprised of a rim formed within said tubular passage.

16. The combination as recited in claim 10, wherein said limiting means is comprised of a flange formed within said tubular passage.

17. The combination as recited in claim 10, wherein said limiting means is comprised of a lip formed within said tubular passage.

18. The combination as recited in claim 10, wherein said limiting means is comprised of a decreased diameter of said tubular passage.

19. The combination as recited in claim 10, wherein said at least one aperture further comprises a socket formed at the internal end of said aperture.

* * * * *